US006018265A

United States Patent [19]

Keshtbod

[11] Patent Number: 6,018,265

[45] Date of Patent: Jan. 25, 2000

[54] INTERNAL CMOS REFERENCE GENERATOR AND VOLTAGE REGULATOR

[75] Inventor: Parviz Keshtbod, Los Altos Hills, Calif.

[73] Assignee: Lexar Media, Inc., Fremont, Calif.

[21] Appl. No.: 09/052,038

[22] Filed: Mar. 30, 1998

Related U.S. Application Data

[60] Provisional application No. 60/069,026, Dec. 10, 1997.

[51] Int. Cl.[7] ..... G05F 1/10; G05F 3/02

[52] U.S. Cl. ..... 327/540; 327/541; 327/544

[58] Field of Search ..... 327/538, 540, 327/541, 543, 544, 539, 83; 323/313, 314

[56] References Cited

U.S. PATENT DOCUMENTS

| | | | |
|---|---|---|---|
| 4,939,442 | 7/1990 | Carvajal et al. | 323/281 |
| 5,129,974 | 7/1992 | Aurenius | 283/81 |
| 5,140,191 | 8/1992 | Nogle et al. | 326/87 |
| 5,146,152 | 9/1992 | Jin et al. | 323/280 |
| 5,173,656 | 12/1992 | Seevinck et al. | 323/314 |
| 5,280,198 | 1/1994 | Almulla | 327/535 |
| 5,289,111 | 2/1994 | Tsuji | 323/314 |
| 5,360,747 | 11/1994 | Larson et al. | 437/8 |
| 5,508,635 | 4/1996 | Kwon | 326/27 |
| 5,787,174 | 7/1998 | Tuttle | 380/23 |
| 5,801,067 | 9/1998 | Shaw et al. | 438/15 |
| 5,801,575 | 9/1998 | Bouvier | 327/530 |

*Primary Examiner*—Timothy P. Callahan
*Assistant Examiner*—An T. Luu
*Attorney, Agent, or Firm*—Maryam Imam

[57] ABSTRACT

The present invention includes a circuit for deriving a reference signal having a reference voltage from a system voltage source having a system voltage level and for regulating the reference voltage level. The circuit includes an output sub-circuit, a reference generator sub-circuit, a regulator sub-circuit, a translator sub-circuit, and a low pass filter sub-circuit. The output sub-circuit, which is coupled to the system voltage source, is responsive to a voltage control signal, and is operative to generate the reference signal wherein the reference voltage level is less than or equal to the system voltage level. The reference generator sub-circuit is responsive to the reference signal and is operative to generate a prime voltage level which remains substantially unaffected by fabrication process variations, temperature variations and variations in the reference signal. The regulator sub-circuit is responsive to the reference signal and the prime voltage level and is operative to generate the voltage control signal. The translator sub-circuit is coupled to the system voltage source and functions to amplify the voltage control signal. The low pass filter sub-circuit is used for filtering the voltage control signal. The output sub-circuit includes an output transistor having its gate coupled to receive the voltage control signal, its source connected to the system voltage source, and its drain connected to an output terminal at which the reference signal is provided.

21 Claims, 13 Drawing Sheets

| FIG. 2a | FIG. 2b | FIG. 2c |
|---|---|---|

Key To FIG. 2

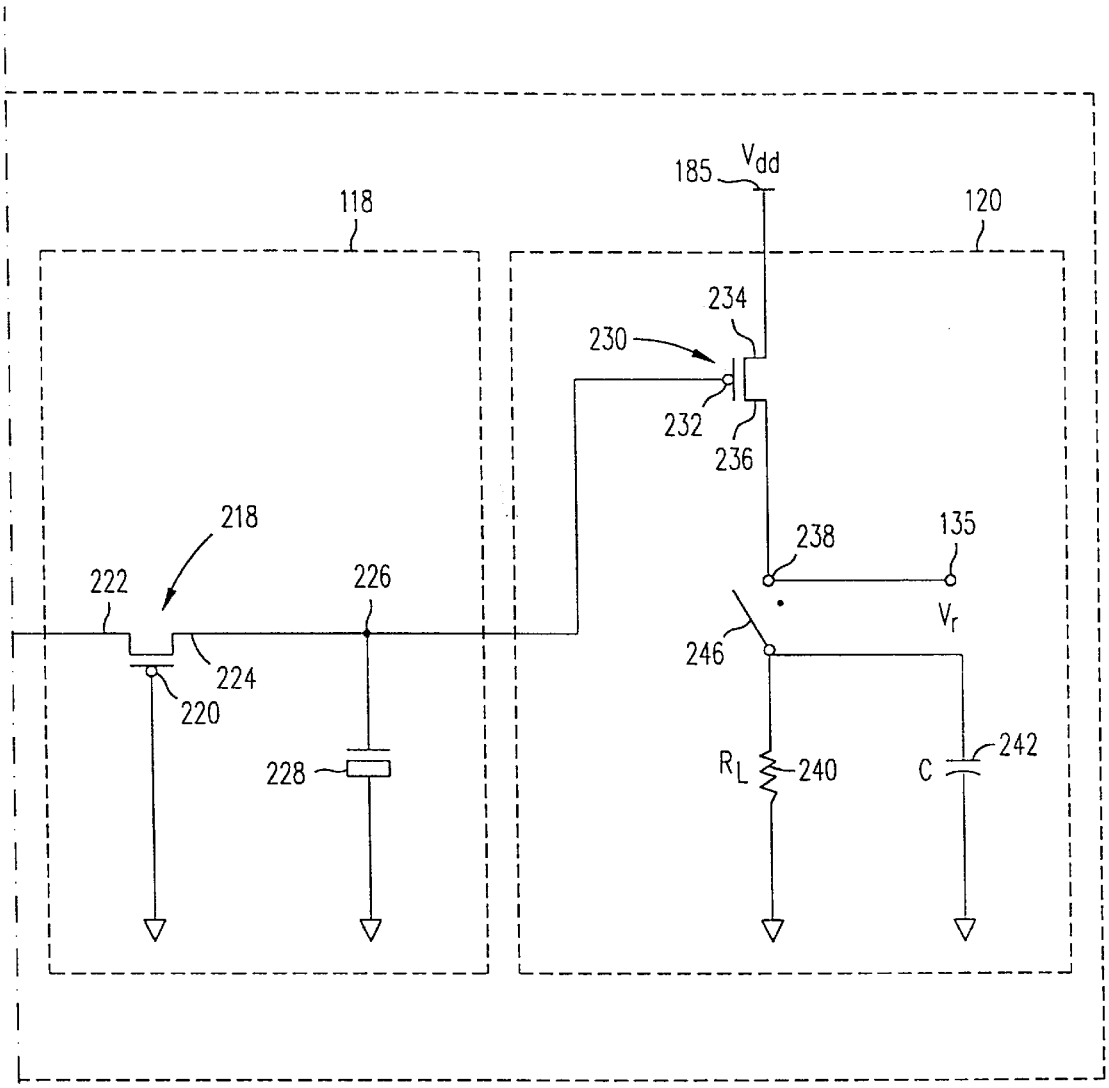
FIG. 3c
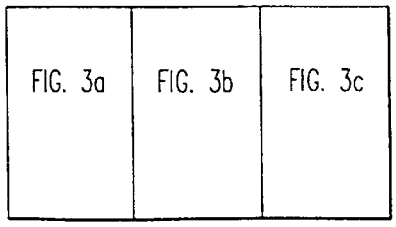
Key To FIG. 3

Key To

INTERNAL CMOS REFERENCE GENERATOR AND VOLTAGE REGULATOR

PRIORITY CLAIM

This application claims the benefit of my prior filed copending provisional application entitled "Internal CMOS Reference Generator and Voltage Regulator" filed on Dec. 10, 1997, having an Application No. 60/069,026.

BACKGROUND OF THE INVENTION

1. Field of the Invention

The present invention relates generally to circuitry used for the purpose of voltage regulation. Specifically, the present invention relates to a circuit for deriving a reference voltage signal from a system voltage source and for regulating the reference voltage signal so that it remains substantially unaffected by variations in the system voltage level, temperature of the environment, and processing related variations of circuit components.

2. Description of the Prior Art

Typically, an electronic system includes a system voltage source providing a system voltage level $V_{dd}$ for its electronic sub-systems. Some electronic subsystems require voltage sources which provide particularly stable voltage levels not equal to the system voltage level Vdd. For example, solid state memory storage systems, such as flash memory components used in a portable computer, suffer in performance when the reference voltage is not maintained within predefined tolerance levels.

There exists in the prior art a variety of methods and circuit devices for deriving a reference voltage signal from a system voltage source. There also exists a variety of methods and circuit devices for regulating voltage levels.

FIG. 1 shows a schematic diagram of an exemplary prior art voltage regulator circuit 10. Circuit 10 comprises: a system voltage source 12; a voltage divider including a first resistor 14 having one terminal connected to voltage source 12 and an opposite terminal connected to a node 16, and a second resistor 18 having one terminal connected to ground and an opposite terminal connected to node 16; an operational amplifier (OP-Amp) 20 having a reference input 22 connected to node 16, a feedback input 24, a power input 28 connected to system voltage source 12, and an output 26; a bipolar transistor 40 having its base 42 connected to output 26, its emitter 44 connected to system voltage source 12, and its collector 46 connected to a node 47; a load resistor 50 having one terminal connected to a node 48 and an opposite terminal connected to ground; and a capacitor 52 having one terminal connected to node 48 and an opposite terminal connected to ground. Circuit 10 generates an output reference voltage $V_r$ across terminals 47 and 48. Feedback input 24 of Op-Amp 20 is connected to terminal 48. A switch 54 selectively connects terminals 47 and 48.

The voltage divider is responsive to system voltage source 12 to generate a source reference voltage level $V_{ref}$ at node 16. Op-Amp 20 is responsive to the source reference voltage level $V_{ref}$ received at input 22 and the output voltage reference level $V_r$ received at feedback input 24 to generate an output voltage level $V_O$ at its output 26 wherein voltage level $V_O$ which is proportional to the difference between the source reference voltage level $V_{ref}$ and the output reference voltage level $V_R$. The output voltage level $V_O$ is increased when $V_{ref}<V_R$ and is decreased when $V_{ref}>V_R$.

Transistor 40 is a p-n-p type bipolar transistor and in the active mode, the collector current $I_C$ through transistor 40 increases as the positive bias $V_O$ across the base junction of transistor 40 is decreased.

When $V_{ref}=V_r$, the output voltage level $V_O$ provided at output 26 of the Op-Amp 20 is at a threshold level, transistor 40 is in the active region, and the output reference voltage level $V_r$ across nodes 47 and 48 for example is at 3.3 volts. If the system voltage level $V_{dd}$, increases due to a power supply variation, then the output voltage reference level $V_r$ generated at the output terminal is increased. In response, the output voltage level $V_O$ provided at output 26 of the Op-Amp 20 increases causing a decrease in the collector current $I_C$ through transistor 40; and a decrease in the output voltage reference level $V_r$ to compensate for the increase in $V_{dd}$.

If the system voltage level $V_{dd}$ decreases, then the output voltage reference level $V_r$ generated at the output terminal is decreased. In response, the voltage level $V_O$ provided at output 26 of the Op-Amp decreases causing an increase in the collector current $I_C$ through transistor 40 and an increase in the output voltage reference level $V_r$ to compensate for the decrease in $V_{dd}$. The problem with this technique is that fluctuations in $V_{dd}$ change Vref due to the proportionality between $V_{ref}$ and $V_{dd}$. This causes $V_r$ to follow the changes in $V_{dd}$. As an example, if $V_{dd}$ drops by 10%, Vref will also drop by 10%, as does $V_r$.

In general, fluctuations in the system voltage level $V_{dd}$ may result from power supply variances and other like affects. Fluctuations in the reference voltage level generated by a reference generator often arise due to variations in temperature of the environment. For example, temperature variations in the environment of an electronic system may range from 0° C. to 95° C. Fluctuations in the reference voltage level may also arise due to processing related variations of the circuit components of the reference generator. Reference generator circuitry implemented using complementary metal oxide semiconductor (CMOS) technology is particularly susceptible to voltage fluctuations caused by process related variations of the circuit components of the reference generator. This is partly due to the fact that N-channel and P-channel transistors are known to operate differently under varying temperatures.

FIG. 1*a* shows an application of the prior art voltage generator and regulator circuit 10 of FIG. 1. This application in particular relates to a solid state storage system 324, which includes a controller 310, a voltage regulator and generator circuit 312 and a flash memory unit 322. The controller 310 controls the operation of and supplies power to the flash memory unit 322. In so doing, the controller 310 supplies a $V_r$ signal (generally at 3.3V) to the flash unit 322 through the use of the regulator circuit 312. The latter is similar in operation to the prior art circuit shown in FIG. 1 herein. In FIG. 1*a,* the regulator circuit 312 is shown to reside, in part, within the controller and in part, outside of the controller 310.

Specifically, the transistor 40 and capacitor 52 of the circuit 10 of FIG. 1 are shown included in the regulator circuit 312 but residing outside of the controller 310. These components occupy space on, for example, a card upon which the system 312 may be placed.

What is needed is a circuit for deriving a reference signal having a reference voltage from a system voltage source having a system voltage level $V_{dd}$ and for regulating the reference signal such that the reference voltage level remains substantially unaffected by variations in the system voltage level $V_{dd}$ and current load.

What is also needed is such a circuit wherein complementary metal oxide semiconductor (CMOS) technology is used to implement the circuit.

What is further needed is such a circuit wherein the voltage level of the reference signal remains substantially unaffected by variations in the behavior of components of the circuit due to processing characteristics and temperature characteristics of the components.

SUMMARY OF THE INVENTION

It is an object of the present invention to provide a circuit for deriving a reference signal having a reference voltage from a system voltage source having a system voltage level and for regulating the reference voltage level such that the reference voltage level remains substantially unaffected by variations in the system voltage level and variations in temperature.

Briefly, a presently preferred embodiment of the present invention includes a circuit for deriving a reference signal having a reference voltage from a system voltage source having a system voltage level and for regulating the reference voltage level. The circuit includes an output sub-circuit, a reference generator sub-circuit, a regulator sub-circuit, a translator sub-circuit, and a low pass filter sub-circuit.

The output sub-circuit, which is coupled to the system voltage source, is responsive to a voltage control signal, and is operative to generate the reference signal wherein the reference voltage level is less than or equal to the system voltage level. The reference generator sub-circuit is responsive to the reference signal and is operative to generate a prime voltage level which remains substantially unaffected by temperature variations and variations in the reference signal.

The reference generator sub-circuit includes: a first p-channel transistor having its source coupled to receive the reference signal, its gate connected to ground, and its drain connected to a first node at which the prime voltage level is generated; a resistor having a first terminal connected to receive the reference signal and a second terminal connected to the first node; and an N-channel second transistor having its gate coupled to receive the reference signal, its drain connected to the first node, and its source connected to a second node. The reference generator sub-circuit may also include at least one trim transistor having its gate coupled to receive the reference signal, its drain connected to the first node, and its source connected to the second node, wherein the trim transistor is used to adjust the prime voltage level.

The regulator sub-circuit includes a fourth transistor having its source coupled to receive the reference signal, its gate connected to the first node, and its drain connected to a third node at which the voltage control signal is generated. The regular sub-circuit also includes another transistor with its drain connected to a third node, its source to the second node and its gate to an incoming signal. The regulator sub-circuit is responsive to the reference signal and the prime voltage level and is operative to generate the voltage control signal. The translator sub-circuit is coupled to the system voltage source and functions to amplify the voltage control signal. The low pass filter sub-circuit is used for removing jitter from the voltage control signal. The output sub-circuit includes an output transistor having its gate coupled to receive the voltage control signal, its source connected to the system voltage source, and its drain connected to an output terminal at which the reference signal is provided.

An advantage of the present invention is that the voltage level of the reference signal remains substantially unaffected by variations in the system voltage level $V_{dd}$ of the voltage source.

Another advantage is that the reference voltage level remains substantially unaffected by variations in the behavior of components of the circuit due to processing characteristics and temperature characteristics of the components.

The foregoing and other objects, features, and advantages of the present invention will be apparent from the following detailed description of the preferred embodiment which makes reference to the several figures of the drawing.

IN THE DRAWING

FIG. 1 is a schematic diagram of a prior art voltage regulator circuit implemented using bipolar junction transistor and an operation amplifier.

FIG. 1*a* illustrates the use of the prior art voltage regulator circuit of FIG. 1 with a system using nonvolatile memory devices and a controller circuit.

Figure 2A:
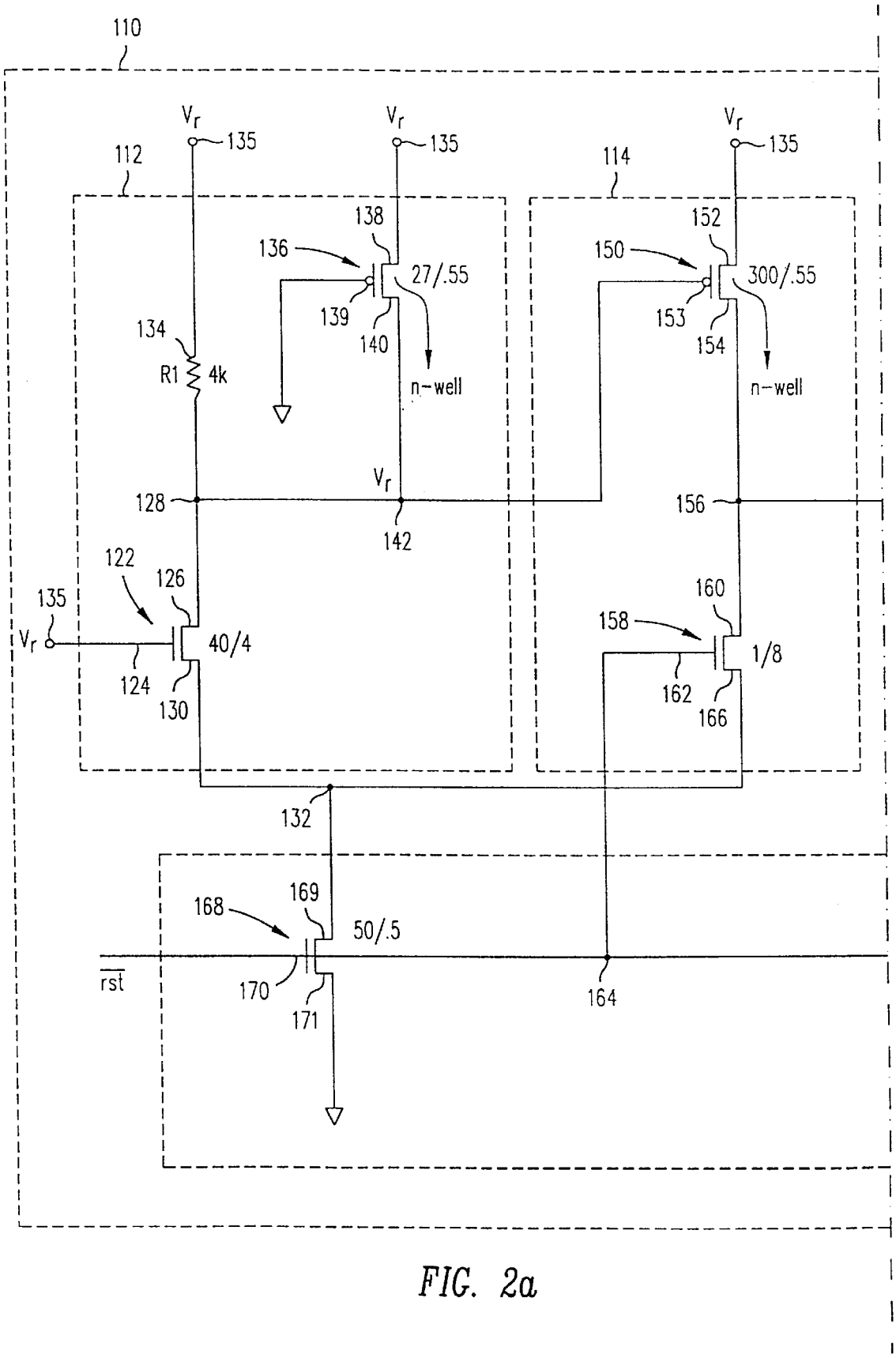
FIG. 2 is a schematic diagram of a CMOS reference voltage generator and voltage regulator circuit according to an embodiment of the present invention.
Figure 2B:
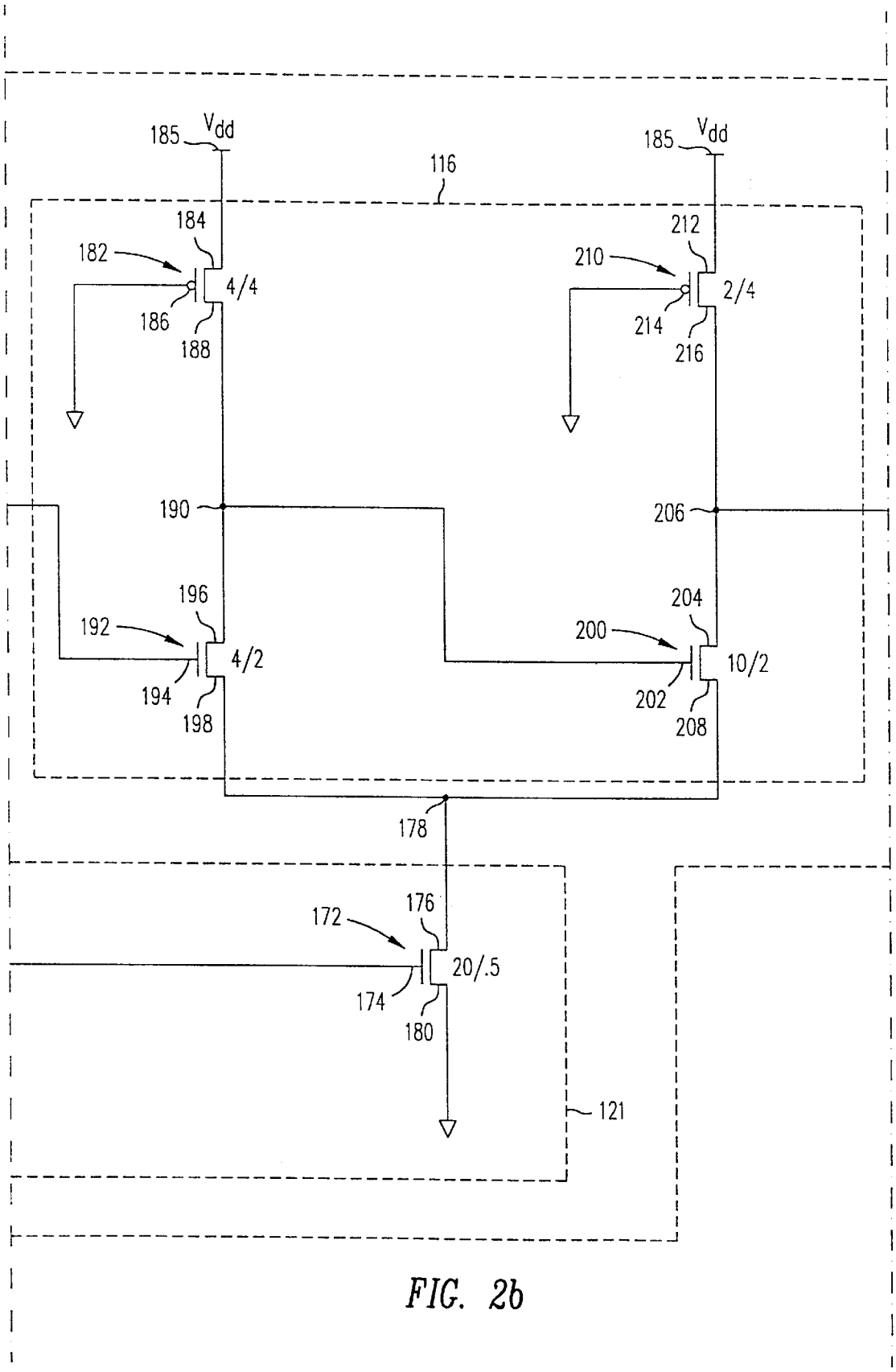
Figure 2C:
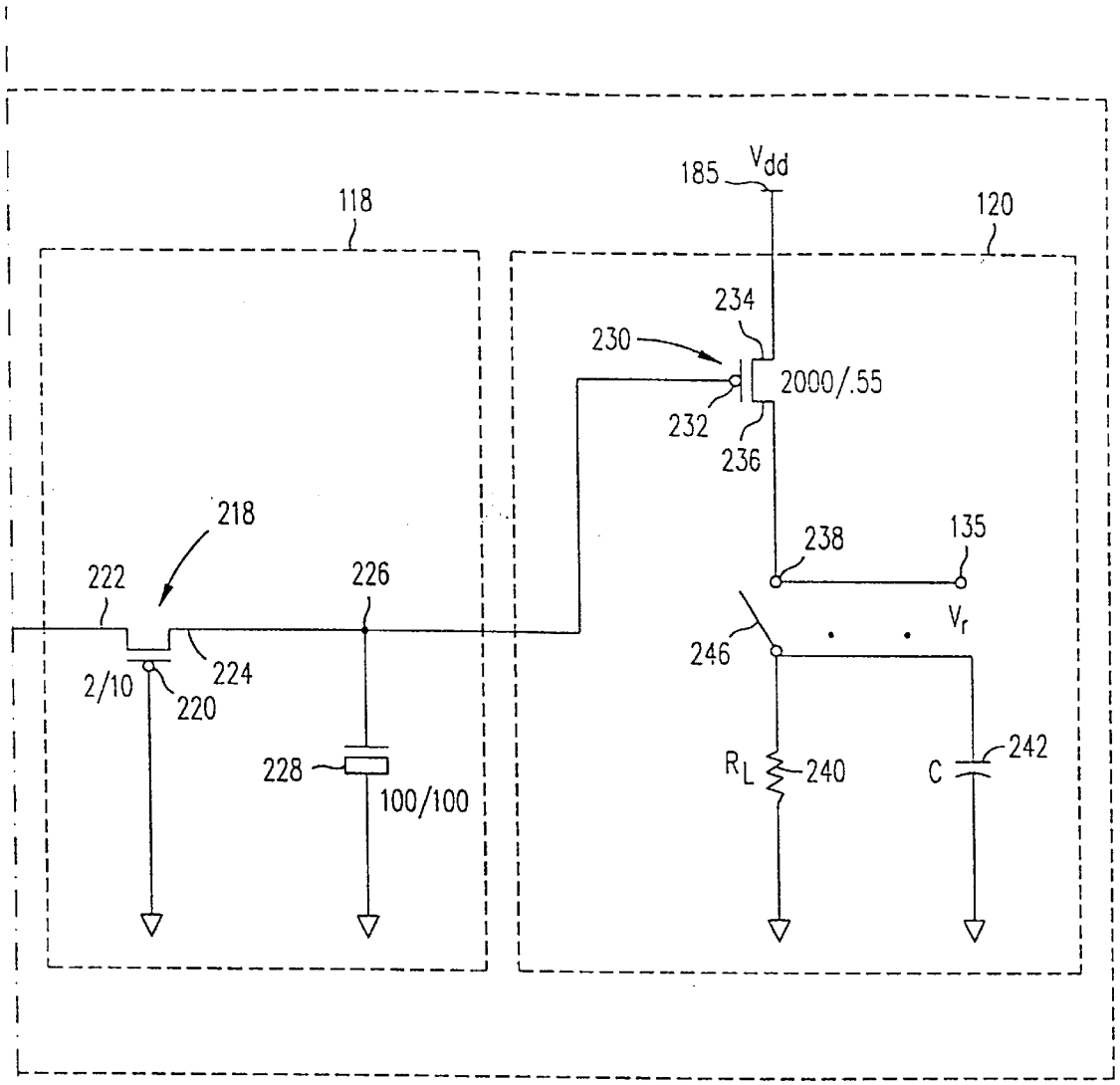
Figure 3A:
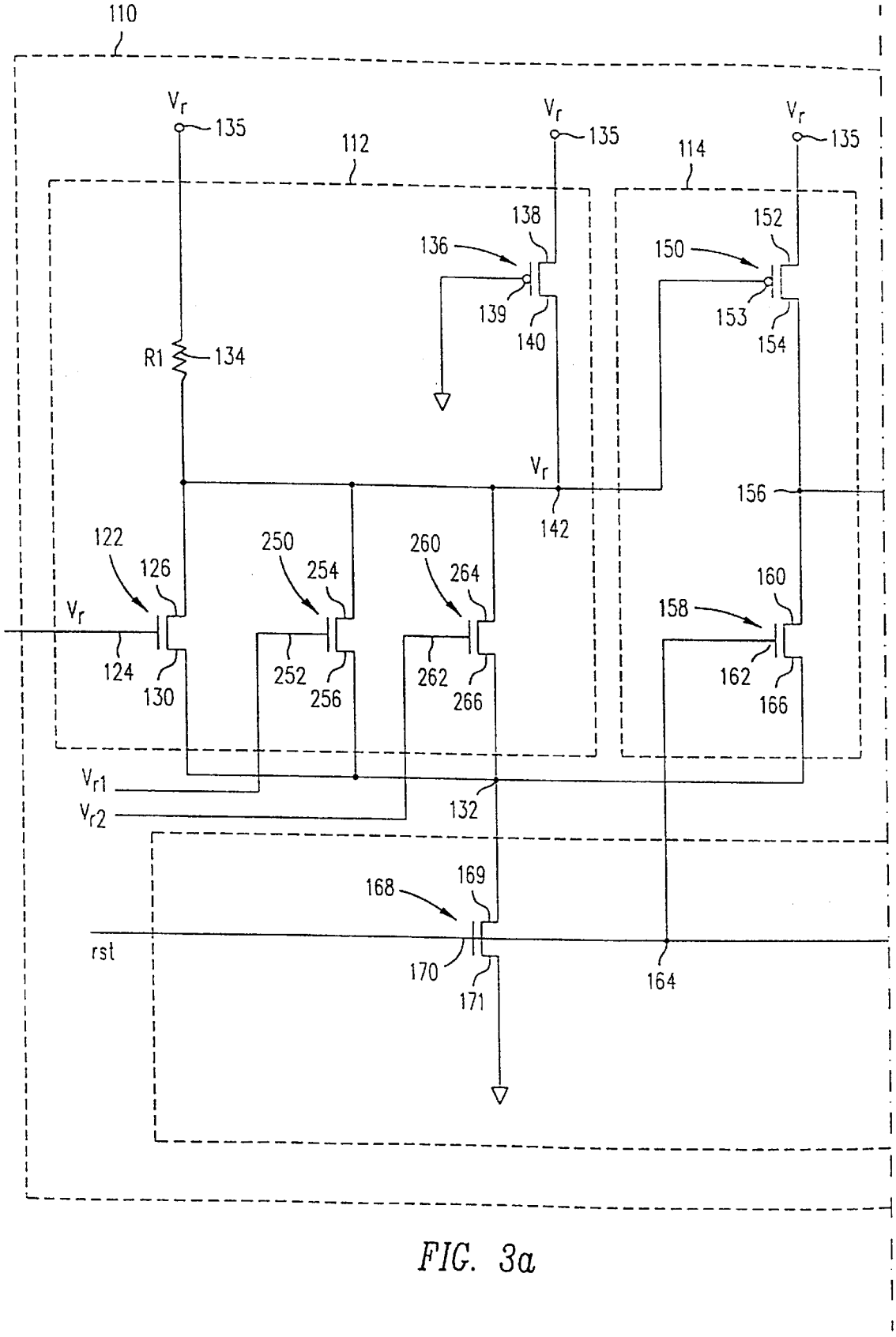
FIG. 3 is a schematic diagram of a CMOS reference voltage generator and voltage regulator circuit according to an alternative embodiment of the present invention.
Figure 3B:
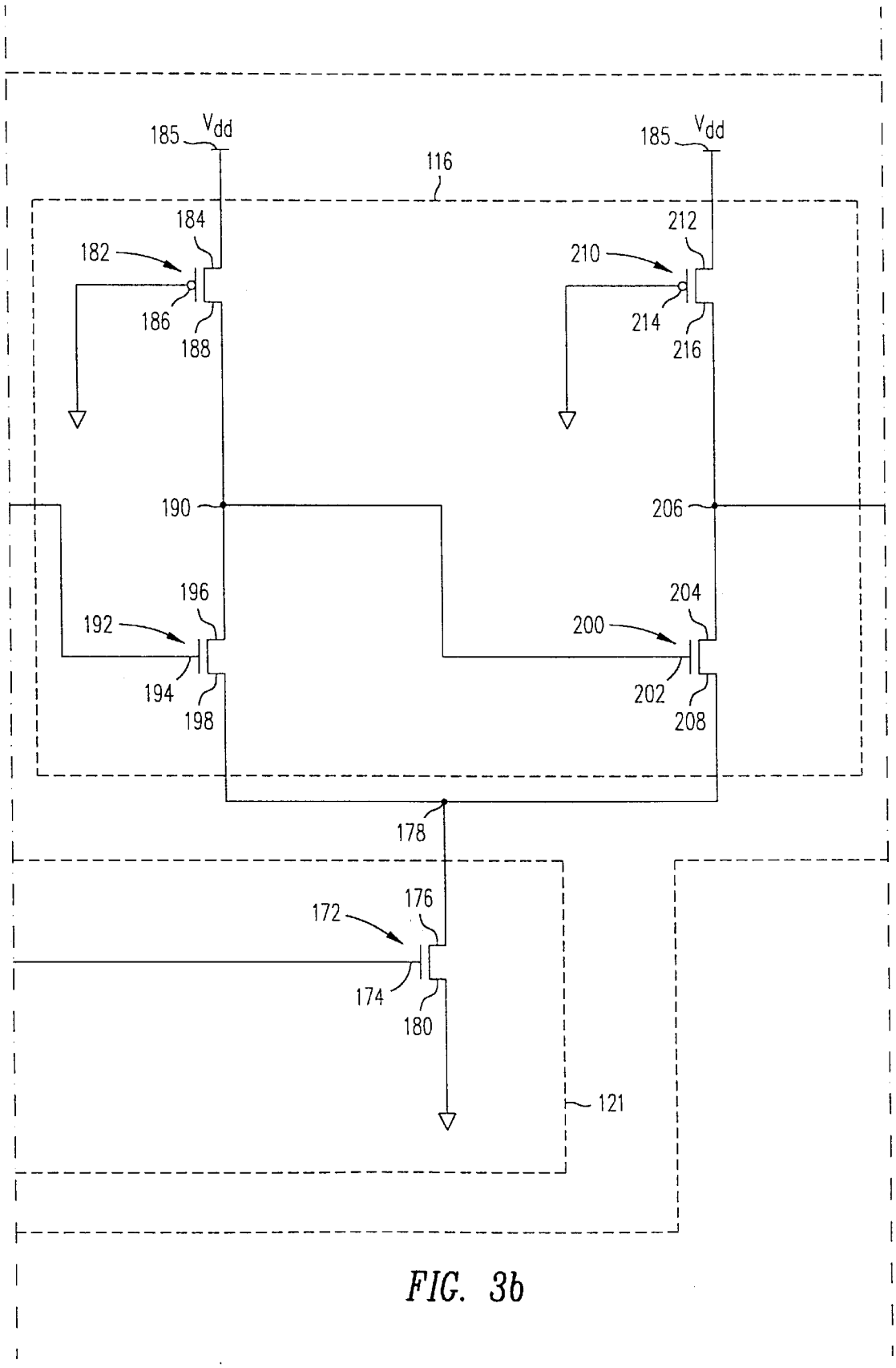
Figure 4A:
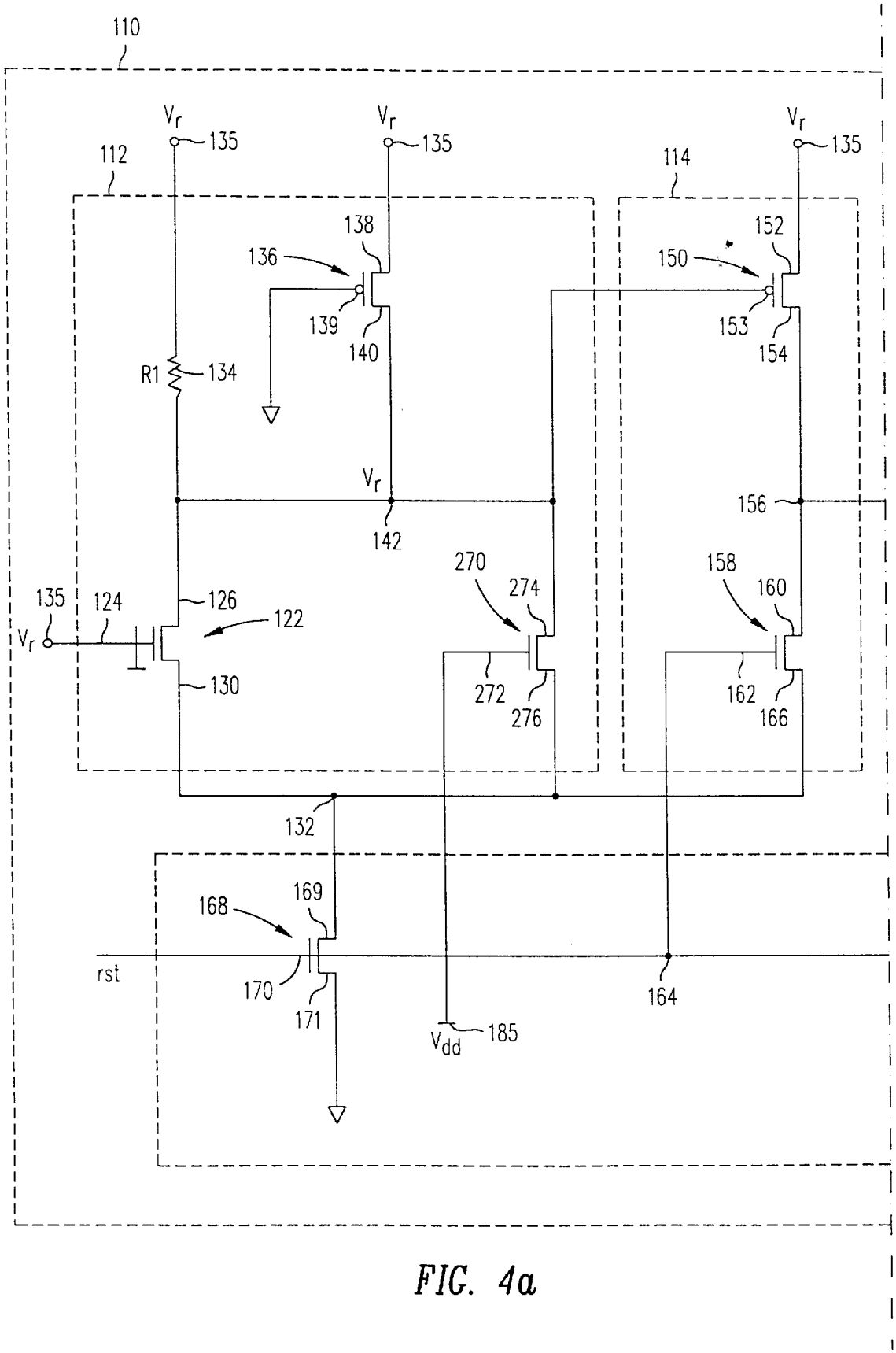
FIG. 4 is a schematic diagram of a CMOS reference voltage generator and voltage regulator circuit according to another alternative embodiment of the present invention.
Figure 4B:
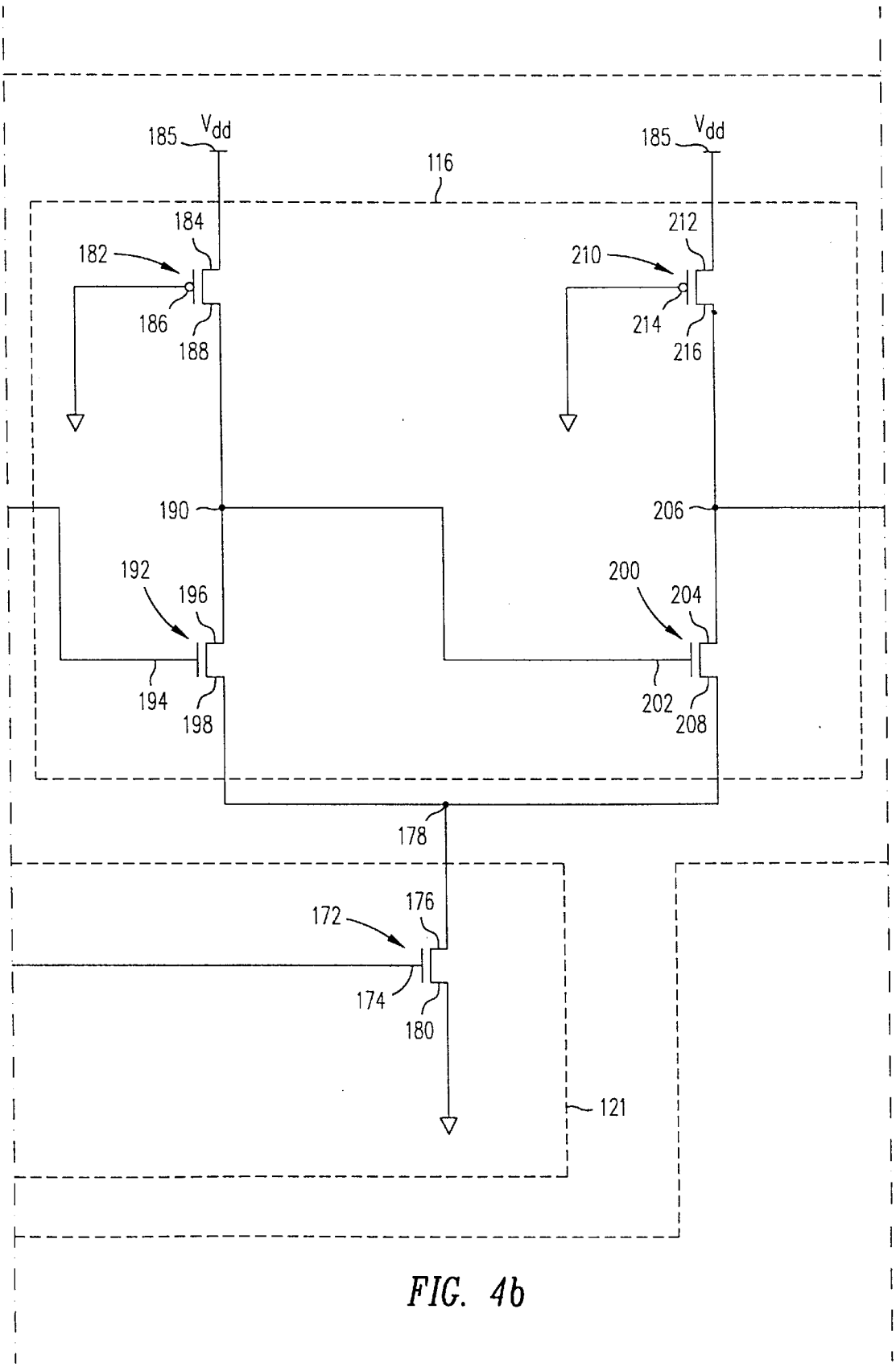
Figure 4C:
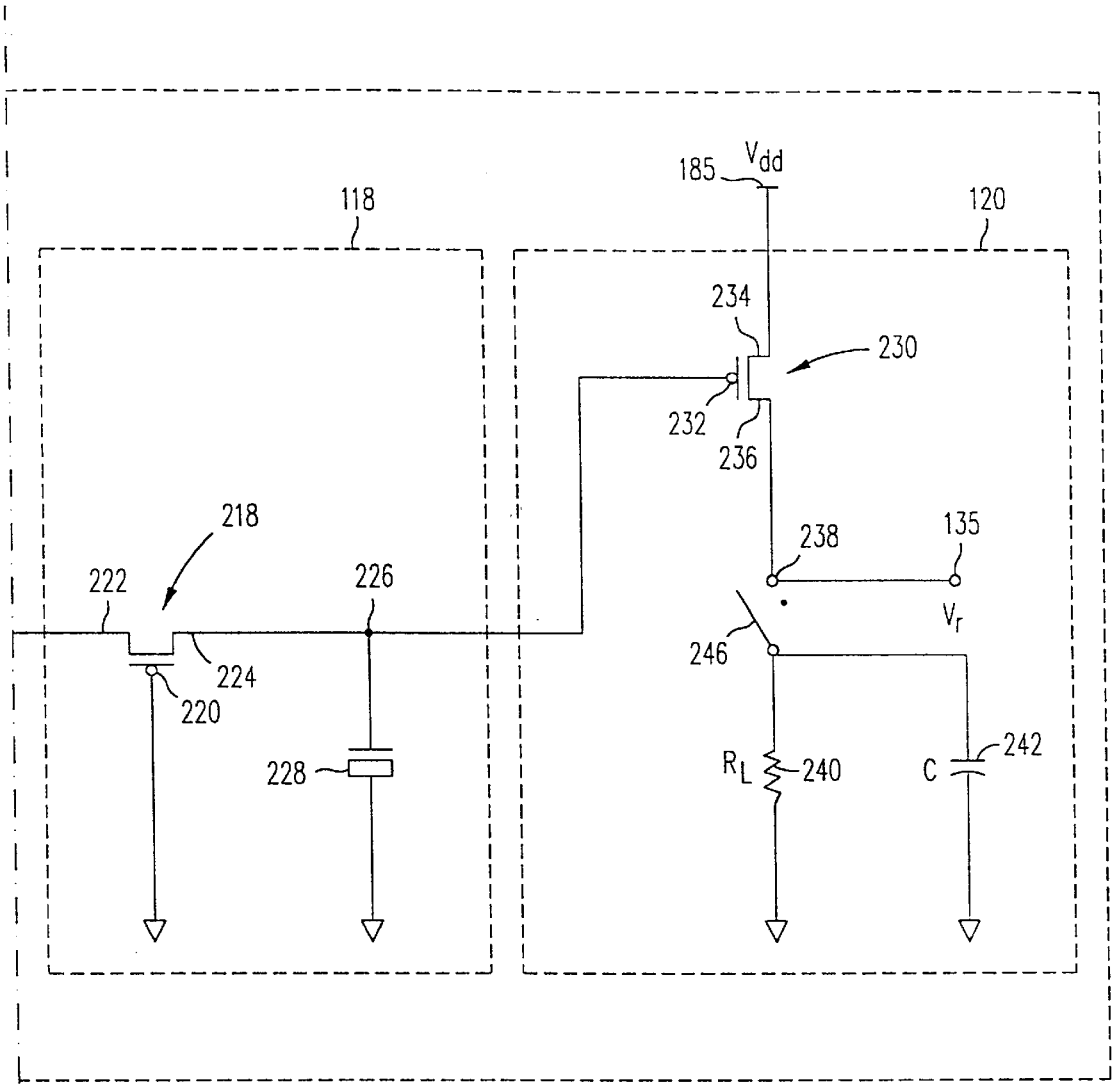
Figure 4:
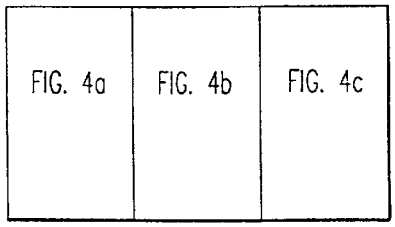
Figure 5:
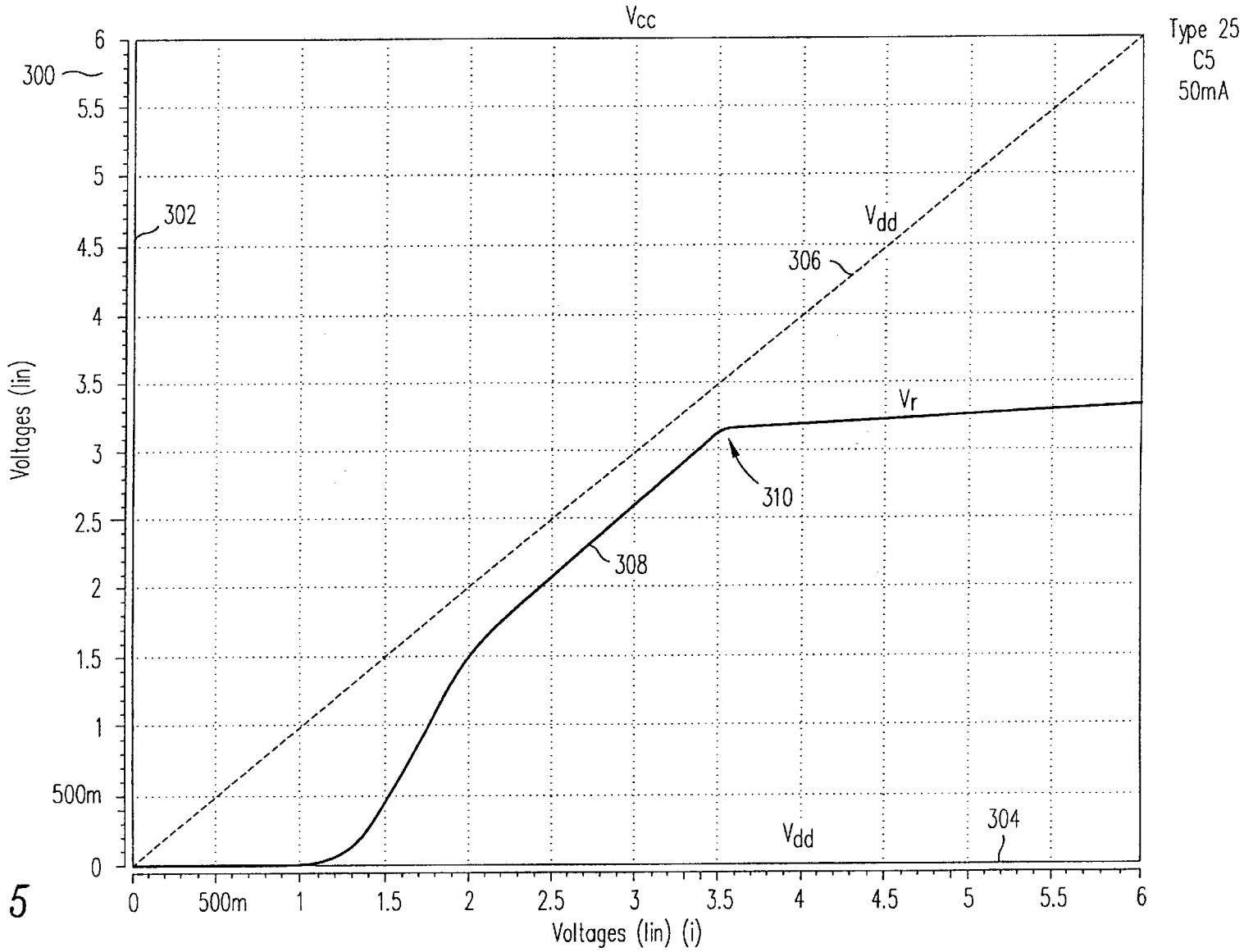
Figure 5A:
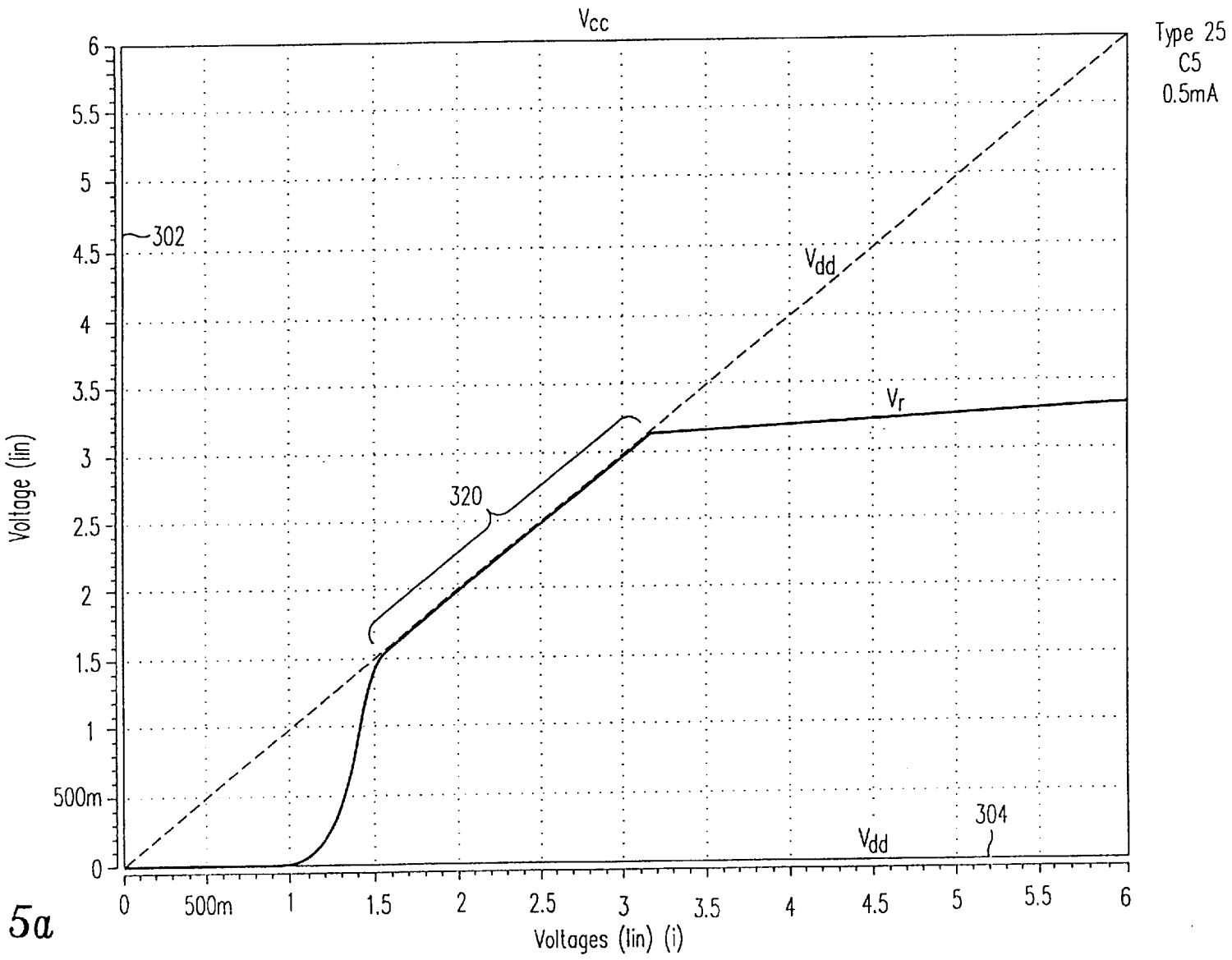

FIGS. 5 and 5*a* are graphs illustrating output reference voltage signals provided by the circuits of FIGS. 2, 3, and 4 as a function of time.

Figure 6:
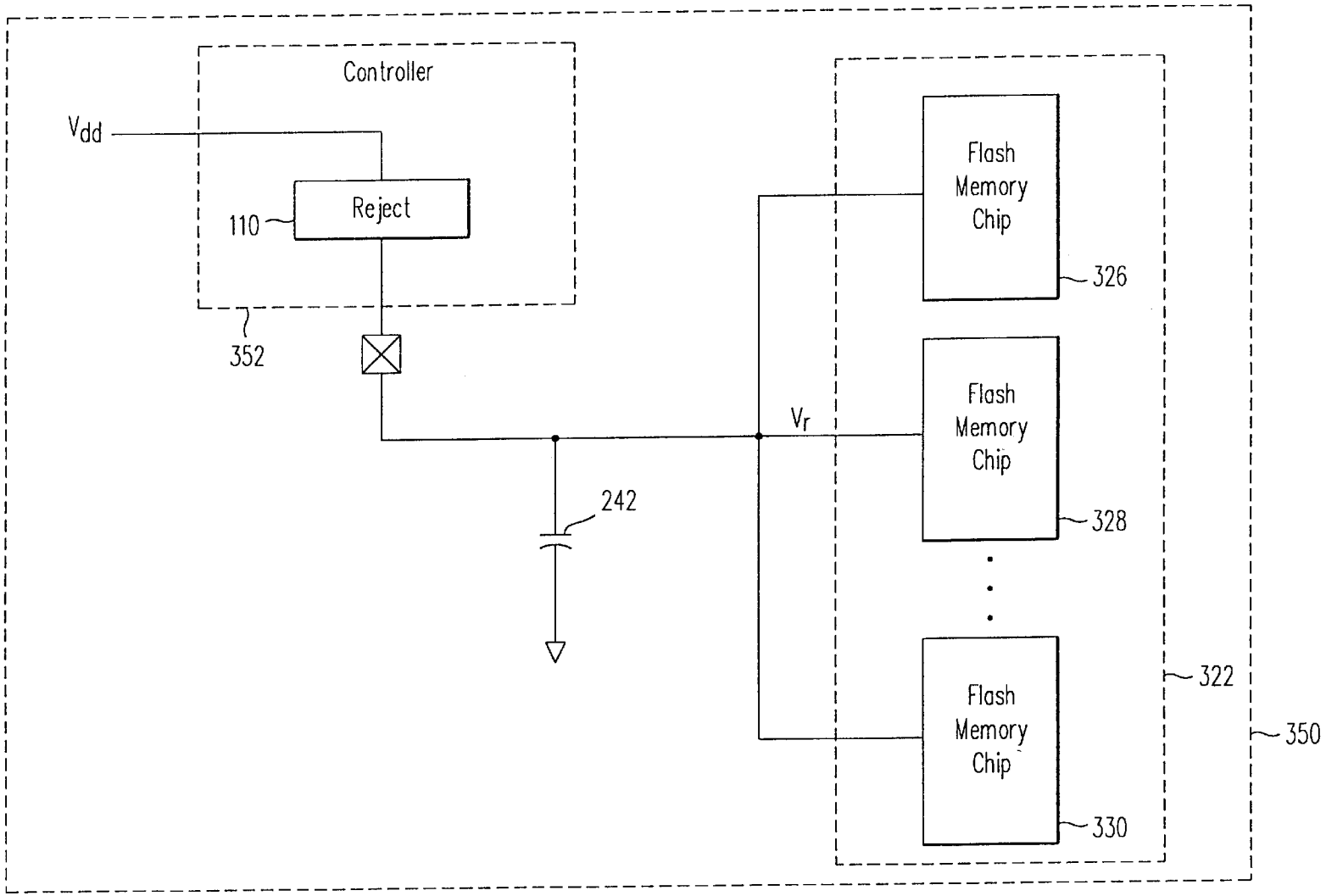

FIG. 6 shows the use of a preferred embodiment CMOS reference voltage generator and regulator in a system having a controller device and nonvolatile memory devices.

DETAILED DESCRIPTION OF THE PREFERRED EMBODIMENTS

Referring now to the drawing, FIG. 2 illustrates a CMOS reference generator and voltage regulator circuit 110 according to principles of the present invention. Circuit 110 includes a voltage reference generator sub-circuit 112, a voltage regulator sub-circuit 114, a voltage translator sub-circuit 116, an RC filter sub-circuit 118, an output sub-circuit 120, and a power conservation sub-circuit 121.

Reference generator sub-circuit 112 includes a transistor 122 having its gate 124 connected to receive a reference signal $V_R$, its drain 126 coupled to a node 128, and its source 130 coupled to a node 132. Sub-circuit 112 also includes a resistor 134 having a first terminal coupled to receive reference signal $V_R$, and a second terminal coupled to node 128. Sub-circuit 112 further includes a transistor 136 having its source 138 coupled to receive reference signal $V_R$, its gate 139 connected to ground, and its drain 140 connected to a prime reference node 142.

Regulator sub-circuit 114 includes a transistor 150 having its source 152 connected to receive reference signal $V_R$, its gate 153 connected to reference node 142, and its drain 154 connected to a node 156. Sub-circuit 114 also includes transistor 158 having its drain 160 connected to node 156, its gate 162 connected to a node 164, and its source 166 connected to node 132.

Power conservation sub-circuit 121 includes a transistor 168 having its drain 169 connected to node 132, its gate 170 coupled to receive a reset signal $\overline{rst}$, and its source 171 connected to ground. Sub-circuit 121 also includes a transistor 172 having its gate 174 connected to node 164 which is connected to gate 170 of transistor 168, its drain 176 connected to a node 178, and its source 180 connected to ground.

Voltage translator sub-circuit 116 includes a transistor 182 having its source 184 connected to a system voltage source 185 which provides a system voltage level $V_{dd}$, its gate 186 connected to ground, and its drain 188 connected to a node 190. Sub-circuit 116 also includes a transistor 192 having its gate 194 connected to node 156, its drain 196 connected to node 190, and its source 198 connected to node 178. Sub-circuit 116 further includes a transistor 200 having its gate 202 connected to node 190, its drain 204 connected to a node 206, and its source 208 connected to node 178. In addition sub-circuit 116 includes a transistor 210 having its source 212 connected to system voltage source 185, its gate 214 connected to ground, and its drain 216 connected to node 206.

RC filter sub-circuit 118 includes a transistor 218 having its gate 220 connected to ground, its source 222 connected to node 206, and its drain 224 connected to a node 226. Sub-circuit 218 also includes a capacitor 228 having one terminal connected to ground and an opposite terminal connected to node 226. In an embodiment, capacitor 228 is implemented as an NMOS transistor having its drain and source both coupled to ground so that capacitance is provided across the gate and body of the transistor.

Output sub-circuit 120 includes a transistor 230 having its gate 232 connected to node 226, its source 234 connected to system voltage source 185, and its drain 236 connected to a node 238.

In the depicted embodiment: transistors 122, 144, 158, 168, 172, 192, 200 and 228 are N-channel CMOS transistors; transistors 136, 150, 182, 210, 220, and 230 are P-channel CMOS transistors; and the system voltage level $V_{dd}$ provided by system voltage source 185 is approximately equal to 5V. However, the system voltage level $V_{dd}$ may be other than 5V so long as $V_{dd}$ is higher than the voltage level $V_r$ of the reference voltage signal generated by the circuit 110.

Transistor 158 is selected in size to be much smaller than transistor 150 so that transistor 158 maintains node 156 at a voltage level approximately equal to 0V when transistor 150 is OFF so that node 156 does not float and thereby maintains a known voltage level. Transistor 150 is several hundred times larger than transistor 158. For example, transistor 150 may be 300/1 in size where as transistor 158 may be ⅛ in size. Because the size of transistor 158 is very small, it consumes very little current and functions like a large resistor.

Capacitor 242 acts as a tank capacitor, to remove noise from the reference signal $V_r$ generated at node 238 as further explained below. It should be noted that resistor 240 and capacitor 242 are not part of the invention.

In Operation

In a power conserving mode, power conservation sub-circuit 121, which is responsive to reset signal $\overline{rst}$, functions to reduce power consumption of circuit 110 when circuit 110 is not being used. The power conserving mode of sub-circuit 121 is explained following a description of the active operation of circuit 110 below. During operation of circuit 110, reset signal $\overline{rst}$ is at a HIGH logic state wherein its voltage level is approximately equal to the system voltage level $V_{dd}$ of the system voltage source 185. During an inoperative state of circuit 110, reset signal $\overline{rst}$ is driven to a LOW logic state wherein its voltage level is approximately zero. When reset signal $\overline{rst}$ is driven HIGH, transistors 168 and 172 are turned ON and the voltages at nodes 132 and 178 are pulled down toward ground.

Output sub-circuit 120 derives the reference signal $V_r$ from the system voltage level $V_{dd}$ provided at system voltage source 185. When transistor 230 of output sub-circuit 120 is turned ON by a voltage control signal received at its gate 232 as explained further below, the voltage level of the reference signal $V_r$ provided at node 238 is equal to the system voltage level $V_{dd}$ minus the voltage drop across transistor 230. Output circuit 120 is operative to modify the voltage level of the reference signal $V_r$ in response to the voltage control signal received from an output of regulator sub-circuit 114 and is communicated via translator sub-circuit 116 and RC filter sub-circuit 118 as further explained below.

The voltage level of the reference signal $V_r$ remains substantially unaffected by variations in the behavior of components of circuit 110 caused by process related characteristics and temperature characteristics of the components and also remains substantially unaffected by variations in the system voltage level $V_{dd}$ of the system voltage source 185. The variation of the system voltage level $V_{dd}$ may result from factors including variations in the system power supply (not shown).

Reference generator sub-circuit 112 is responsive to the reference signal $V_r$ generated at the output terminal of output sub-circuit 120 and is operative to develop a prime reference voltage level $V_r'$ at node 142 that remains substantially constant despite fluctuations in the reference signal $V_r$ caused by temperature variations in the environment of circuit 110, processing related variations in the components of circuit 110, and variations in the system voltage level $V_{dd}$. For example, temperature variations in the environment of an electronic system hosting circuit 110 may range from 0° C. to 95° C. The N-channel and P-channel transistors used to implement circuit 110 are known to operate differently under various temperature constraints. Processing related variations include variations in device characteristics due to variations in the process technology used to manufacture components of circuit 110.

Transistor 136 of reference generator sub-circuit 112 is always ON because it is a P-channel transistor and because its gate 139 is connected to ground. Transistor 122 of sub-circuit 112 is turned ON when node 132 is pulled down toward ground as transistor 168 of sub-circuit 121 is turned ON, as described above. The coupling of resistor 134 and transistors 122 and 136 causes the voltage level of the reference signal $V_r$ to be divided. For example, if the reference voltage level $V_r$ is at 3.3V, the voltage level at reference node 142 is 2V.

In accordance with principles of the present invention, the resistor value R1 of resistor 134 and the sizes of transistors 136 and 144 are chosen so as to maintain the voltage level $V_r'$ at node 142 substantially constant despite fluctuations in the voltage level of the reference signal $V_r'$ variations in temperature, and variations in process related characteristics of the elements of circuit 110. Also, the characteristics of the components of circuit 110 are taken into account in determining appropriate resistance values and transistor sizes for resistor 134 and transistors 122, and 136, so as to minimize the effects of the temperature and process variations on the voltage level $V_r'$ at node 142. The temperature and process variations are compensated by proper design of resistor 134 and transistors 136 and 122. Because these elements have different temperature characteristics, a compensation is possible.

As the temperature rises, the Vt of the transistor 150 drops. In the case where the voltage at node 142 remains constant, transistor 150 turns on, causing the reference voltage $V_r$ to drop. To keep $V_r$ constant while temperature rises, the prime reference voltage $V_r'$ at node 142 has to rise to compensate for a drop in the Vt of transistor 150. The current through the p-channel of transistor 136 and n-channel of transistor 122 drop as temperature rises, but the rate of drop depends on the size of the transistors. With respect to the resistor R1, current decrease with higher temperatures. The voltage at node 142 does not change if the sizes of transistors 136 and 122, and the size of the resistor R1 vary proportionally, but the rate of current change with temperature for these different elements would vary.

By proportionally changing the sizes of transistors 136 and 122 and resistor R1, a set of sizes may be ascertained such that at room temperature, the required Vr' is maintained and also the current node 142 is varied with temperature in such a way that the rise in the $V_r'$ compensates for the fall in Vt of the p-channel transistor 150.

When the fabrication process changes slightly, the reference voltage $V_r$ has to stay relatively constant. As an example, if the process goes toward a fast corner where the length of the gates of transistors become narrower thereby causing the transistor currents to increase and the triggering voltage thresholds of the transistors to drop, the reference voltage $V_r$ should not change.

When the fabrication process causes transistors to operate at fast corner, the Vt of transistor 150 drops and with the same value for $V_r'$ on node 142, transistor 150 turns 'on' thereby causing the voltage at node 156 and the voltage at node 190 to decrease, and the voltages at nodes 206 and 226 to increase. Thereafter, transistor 230 is turned off causing $V_r$ to drop. To compensate for this voltage drop, the voltage at node 142 has to rise.

The gate length of transistor 136 is chosen to be minimum, while the gate length for transistor 122 is chosen to be approximately seven times wider than the minimum. This makes transistor 136 more sensitive to poly gate size variations than transistor 122. Therefore, when poly gates narrow, the current through the transistor 136 rises with faster pace than that of transistor 122, causing the voltage at node 142 to rise. This compensates for the drop in the Vt of transistor 150.

When the fabrication process moves toward slower corners, the opposite of the above occurs and $V_r$ does not change. That is, the transistor currents decrease and the triggering voltage thresholds of the transistors increase causing the reference voltage $V_r$ not to change.

In an embodiment, the resistance value R1 of resistor 134 is 4 K Ohms and the sizes of the transistors 122 and 136 are 40/4 and 27/0.55, respectively. In this embodiment, where the system voltage level $V_{dd}$ of the system voltage source 185 changes from 3.5 to 5.5V, the prime reference voltage level $V_r'$ at reference node 142 fluctuates only by 0.1 volts. The sub-circuits 114 and 120 prevent the voltage at node 142 from fluctuating as a result of variations in Vdd.

Regulator sub-circuit 114 is responsive to the reference signal $V_r$ and the prime voltage level $V_r'$ generated at reference node 142 and is operative to generate a voltage control signal which is provided to gate 232 of transistor 230 of the output sub-circuit 120 via translator sub-circuit 116 and RC filter sub-circuit 118. Regulator sub-circuit 114 develops a voltage at node 156 in response to the prime reference voltage level $V_r'$ at node 142 and the reference voltage level of the reference signal $V_r$. Transistor 150 of sub-circuit 114 is turned ON when the voltage level of the reference signal $V_r$ provided at its source 152 increases to a level that is greater than the voltage level $V_r'$ at reference node 142 which is provided at gate 153 of transistor 150 by one Vt. If, for example, the system voltage level $V_{dd}$ were to swing from 4.5V to 5.5V, the voltage level of the reference signal $V_r$ increases thereby increasing the potential at source 152 of transistor 150 and reduces the voltage $V_r'$ due to the increase in conduction of transistor 122. This reduces the voltage $V_r'$ due to the increase in the conduction of the transistor 122 such that the drive of transistor 150 increases.

When transistor 150 turns ON, the voltage level at node 156 rises very quickly because transistor 150 is much larger than transistor 158. As transistor 150 operates in an active mode, the drive of transistor 150 is controlled by the gate-source bias of transistor 150. When the drive of transistor 150 increases, the voltage level at node 156 is increased toward a maximum value which is equal to the voltage level of the reference signal $V_r$ minus the voltage drop across transistor 150. Sub-circuit 114 provides a voltage control signal at node 156 which is provided to gate 232 of transistor 230 of the output sub-circuit 120 via translator sub-circuit 116 and RC filter sub-circuit 118.

Voltage translator sub-circuit 116 operates to translate the voltage control signal generated at node 156 such that it draws from the system voltage source 185 instead of the voltage level of the reference signal Vr. Since the transistor 230 receives its voltage source from Vdd 185, the gate of transistor 230 at node 232 has to operate from the same power supply, otherwise, the transistor 230 can not be turned 'on' and 'off'. This is the reason for having the translator sub-circuit 116.

Transistor 182 of sub-circuit 116 is always ON because it is a P-channel transistor and its gate 186 is connected to ground. The drive of transistor 192 of sub-circuit 116 is increased when the voltage level at node 156 is increased as described above. When the drive of transistor 192 is increased, the voltage level at node 190 is decreased. The voltage level at node 190 tracks the voltage level at node 156 except that the voltage level at node 190 is an inverted version of the voltage level at node 156. That is, when the voltage level at node 156 increases, the voltage level at node 190 decreases. As discussed above, the voltage level at node 156 ranges between 0V and the voltage level of the reference signal $V_r$ while the voltage level at node 190 ranges between zero and the system voltage level $V_{dd}$.

Similarly, the voltage level generated at node 206 tracks the voltage level at node 190 except that the voltage at node 206 is an inverted version of the voltage level at node 190. Transistor 210 is always ON and acts like a resistor driving the voltage level at node 206 to equal the system voltage level $V_{dd}$ minus the voltage drop across transistor 210. When the voltage level at node 190 is increased the drive of transistor 200 is increased and the voltage level at node 206 is pulled down toward ground. When the drive of transistor 192 is increased, the voltage level at node 190 drops toward ground and as a result, the drive of transistor 200 decreases and the voltage level at node 206 is pulled up toward the voltage level Vdd. Therefore, the voltage level at node 206 ranges between a first voltage level which is approximately equal to 0V and a second voltage level equal to the system voltage level $V_{dd}$. The signal generated at node 206 is a translated version of the voltage control signal generated at node 156 with the difference that node 156 swings from 0 to Vr while node 206 swings from 0 to Vdd. When the voltage at node 206 is increased, the drive of transistor 230 of output sub-circuit 120 decreases.

The voltage control signal generated by the voltage regulator circuit 114 at node 156 oscillates because as the system voltage level $V_{dd}$ of the system voltage source 185 begins to increase, transistor 150 turns ON momentarily and turns OFF again to maintain the voltage level of the reference signal $V_r$ constant. Then, as the voltage level of the reference signal $V_r$ continues to increase, transistor 150 continues to turn ON and OFF resulting in an oscillation of the voltage control signal at node 156. This oscillation similarly affects nodes 190 and 206, and ultimately undesirably affects the voltage level of the reference signal $V_r$.

RC filter sub-circuit 118 operates as a low pass filter to prevent high frequency components of the translated voltage control signal generated at node 206 from passing through to node 226 while passing lower frequency components of the signal. Transistor 218 of sub-circuit 118 is always ON because it is a P-channel CMOS transistor having its gate 220 connected to ground and therefore acts as a resistor. Transistor 218 is very small in size and is designed with capacitor 228 to form an RC circuit.

Output sub-circuit 120 is operative to modify the voltage $V_r$ of the reference signal in response to the voltage control signal generated by the regulator sub-circuit 114 which is provided via translator sub-circuit 116 and RC filter sub-circuit 118 to gate 232 of transistor 230. When the regulator circuit 114 detects an increase in the voltage level of the reference signal $V_r$ at source 152, the drive of transistor 150 increases and the voltage level of the voltage control signal provided at gate 232 of transistor 230 increases to decrease the drive of transistor 230 in order to compensate for the increase in the voltage level of the reference signal $V_r$. When the regulator circuit 114 detects a decrease in the voltage level of the reference signal $V_r$ at source 152, the drive of transistor 150 decreases and the voltage level of the voltage control signal provided at gate 232 of transistor 230 decreases to increase the drive of transistor 230 in order to compensate for the decrease in the voltage level of the reference signal $V_r$.

For example, if the system voltage level $V_{dd}$ of the system voltage source 185 swings from 4.5V to 5.5V, the voltage level of the reference signal $V_r$ generated at node 238 will increase because the output voltage level of the reference signal $V_r$ is equal to the system voltage level $V_{dd}$ minus the voltage drop across transistor 230. As described above, such an increase in the voltage level of the reference signal $V_r$ results in circuit behavior effects including: (1) the drive of transistor 150 increasing; (2) the voltage level at node 156 going up toward the voltage level of the reference signal $V_r$ thereby increasing the voltage level of the voltage control signal; (3) the drive of transistor 192 increasing; (4) the voltage level at node 190 going down toward ground; (5) the drive of transistor 200 decreasing; (6) the voltage level at node 206 going up toward $V_{dd}$; and (7) the drive of transistor 230 decreasing due to a decrease in the bias across the source and gate of transistor 230 thereby preventing the voltage level of the reference signal $V_r$ from increasing any further. In summary, as the system voltage level $V_{dd}$ increases, the voltage level of the reference signal $V_r$ also increases, but at a much slower rate.

The circuit 110 also compensates for an increasing load current drawn from output node 238. When the load current increases, the voltage level of the reference signal $V_r$ tends to drop causing transistor 150 to turn OFF. This causes nodes 156 and 206 to drop thus lowering the voltage at the gate 232 of transistor 230 thereby increasing the drive of transistor 230 to prevent the output voltage level of the reference signal $V_r$ from decreasing further.

As mentioned above, the power conserving mode of power conservation sub-circuit 121 allows reduction of power consumption when circuit 110 is not being used. When reset signal $\overline{rst}$ is LOW, transistors 168 and 172 of power conservation sub-circuit 121 are turned OFF and no current flows at nodes 132 and 178. Node 156 is therefore pulled up to a voltage level approximately equal to $V_r$. The voltage level at node 206 is pulled up to a voltage level which is approximately equal to $V_{dd}$. Therefore, the voltage at node 226 is increased to $V_{dd}$ and transistor 230 is turned OFF. Total current consumption of the regulator goes to zero.

Figure 1:
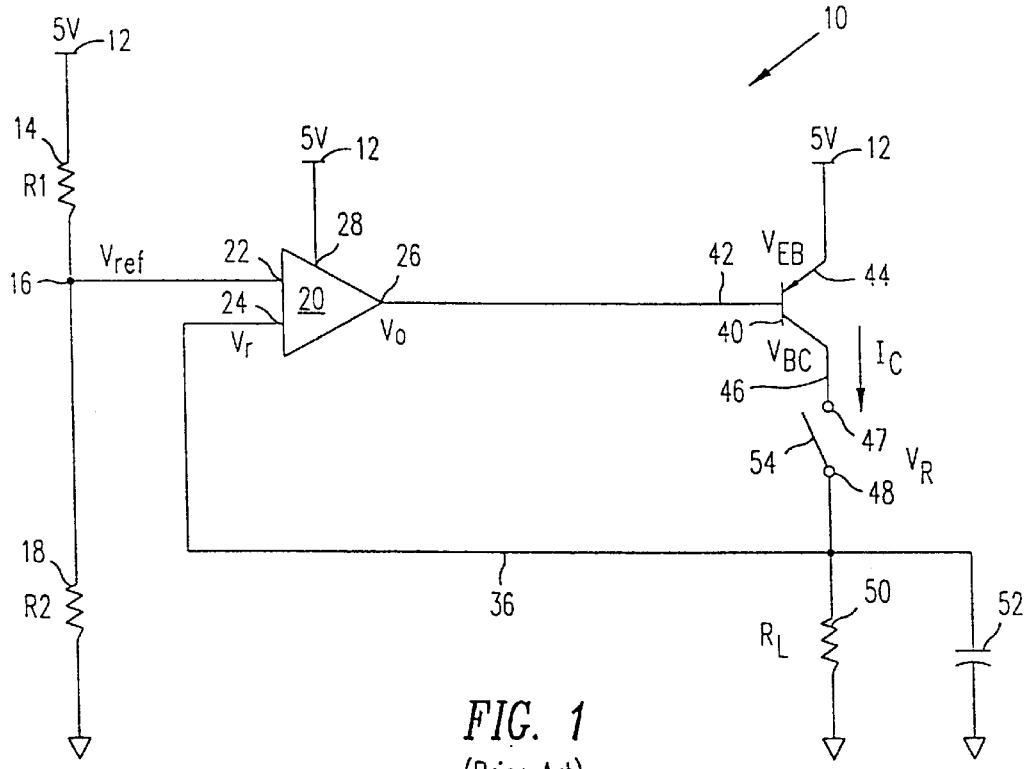
FIG. 1 (Prior Art)

FIG. 3 is a schematic diagram of a reference generator and voltage regulator circuit according to an alternative embodiment of the present invention. The depicted circuit includes the elements of circuit 110 (FIG. 1) and in addition includes a transistor 250 and a transistor 260. Transistor 250 is connected in parallel to transistor 122 and has its gate 252 connected to receive a first auxiliary reference signal $V_r$1, its drain 254 connected to node 142, and its source 256 connected to node 132. Similarly, a transistor 260 is connected in parallel to both transistor 122 and transistor 250 and has its gate 262 connected to receive a second auxiliary reference signal $V_r$2, its drain 264 connected to node 142, and its source 266 connected to node 132. Auxiliary reference signals $V_r$1 and $V_r$2 provide auxiliary reference voltages that may be used in addition to the reference signal $V_r$ to create other voltage values for $V_r$ as well as a trimming effect in fine tuning the voltage level of the reference signal $V_r$ generated by circuit 110. P-channel (PMOS) transistors (not shown), each placed in parallel with transistor 136, can also be used for trimming $V_r$.

Each transistor 122, 250, and 260 that is turned ON creates a drop in the prime reference voltage level $V_r'$ at node 142 and consequently affects the voltage level of the reference signal $V_r$. For example, if only transistor 122 is turned ON, the voltage level $V_r'$ at node 142 becomes 2.0V thereby causing the reference signal $V_r$ to drop from 3.3 to 3.1V. If the transistor 250 is additionally turned ON, the voltage level at reference node 142 becomes 1.9V thereby further reducing the voltage of the reference signal $V_r$ to less than 3.1V and so on. Additional transistors may be similarly coupled in parallel with transistor 122 (or transistor 136) and coupled to receive additional auxiliary reference voltages to control and obtain a desired voltage level of the reference signal $V_r$.

Optionally, the auxiliary reference signals $V_r$1 and $V_r$2 supplied to the gate terminals of transistors 122, 250, and 260 may be software-controlled so that digital values representing voltage levels associated with the reference signal $V_r$ are stored in registers (not shown) and as the values stored in the registers are changed by software, different voltage levels of the reference signal $V_r$ are produced.

FIG. 4 illustrates another alternative embodiment of the circuit 110 (FIG. 1) wherein an N-channel dampening transistor 270 has its gate 272 to system voltage source 185, its drain 274 connected to reference node 142, and at its source 276 to node 132. The size of dampening transistor 270 is chosen to be small and it remains ON during the operation of the circuit 110. In an embodiment, the size of dampening transistor 270 is 2/10. The effect of adding dampening transistor 270 to circuit 110 is explained below in reference to FIG. 5.

FIG. 5 illustrates a graph 300 of voltage 302 as a function of $V_{dd}$ 304. This graph is shown to illustrate the operation of circuit 110 (FIG. 2) to better illustrate the regulation of the voltage level of the reference signal $V_r$ in response to fluctuations in the system voltage level $V_{dd}$ of system voltage source 185 (FIG. 2). A slope 306 shows the rate of change of the system voltage level $V_{dd}$ as a function of $V_{dd}$ and a slope 308 represents the rate of change of the reference signal $V_r$ as a function of $V_{dd}$. As depicted, the reference signal $V_r$ tracks the system voltage level $V_{dd}$ fairly consistently up to a point 310 at which the voltage level $V_r$ is 3.2V. Up to the voltage level 3.2V, at point 310, the regulator sub-circuit 114 of circuit 110 is effectively not regulating and the voltage level of the reference signal $V_r$ substantially tracks the system voltage level $V_{dd}$. After the voltage associated with 310 in FIG. 5 however, as the system voltage level $V_{dd}$ changes, the reference signal $V_r$ remains fairly constant. For example, as the system voltage level $V_{dd}$ changes from 3.5V to 5.5V, the voltage level of the reference signal $V_r$ changes from 3.2V to approximately 3.3V, which is a change of 0.1V as opposed to the 2.0V swing experienced by the system voltage level $V_{dd}$ of the system voltage source 185. Therefore, regulation of the reference signal begins only after the voltage level of the reference signal $V_r$ reaches 3.2V and thereafter the reference signal $V_r$ is maintained fairly constant despite significant increase in the system voltage level $V_{dd}$.

In FIG. 5, the variation of Vdd from 3.5V to 5.5V causes a variation of 3.2 to 3.3V on the reference voltage $V_r$. The transistor 270 (in FIG. 4) is designed to reduce this variation on $V_r$ to even lower values. Since the gate of the transistor 270 is connected to $V_{dd}$, at higher values of $V_{dd}$ (e.g. 5.5V), more current goes through the transistor 270 causing the voltage at node 142 to decrease at higher $V_{dd}$ values. This lower voltage at node 142 (at higher $V_{dd}$ values) reduces $V_r$. With proper sizing of transistor 270, the reference voltage $V_r$ would stay the same (e.g. 3.3V) as $V_{dd}$ varies from 3.5V to 5.5V. A very large size of transistor 270 could cause $V_r$ to be lower at $V_{dd}$=5.5V than 3.5V. The data shown by the graph of FIG. 5 was assuming that the circuit 110 is driving a load drawing 50 mA. That is, the value of the resistance of R1 240 is 66 Ohms. FIG. 5*a* shows the same kind of information as that of FIG. 5 but using a load of 6600 Ohms drawing 0.5 mA. As shown at 320, $V_r$ tracks $V_{dd}$ even more closely at a time when the regulator sub-circuit is not regulating.

Figure 1A:
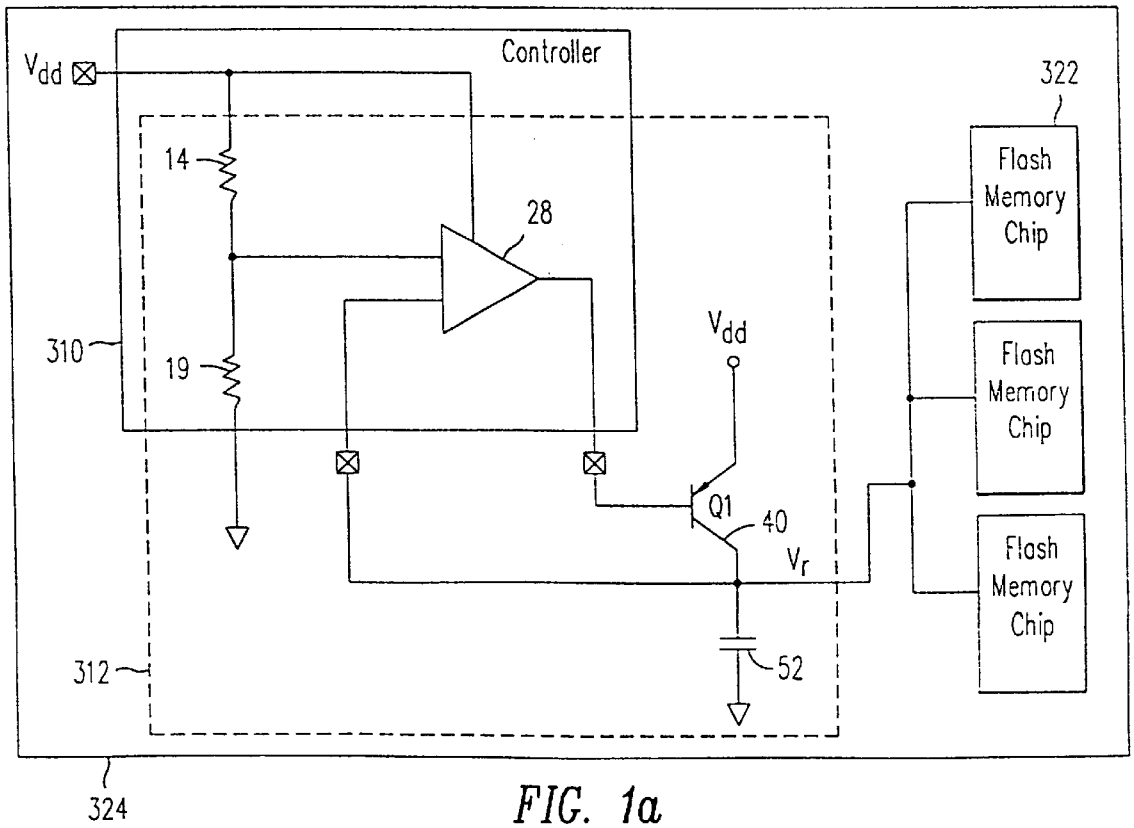
FIG. 1a (Prior Art)

FIG. 6 shows the same application as that of the prior art application shown in FIG. 1*a* but with the use of a CMOS voltage generator and regulator 110 embodiment of the present invention. That is, the solid state storage system 350 includes a controller semiconductor device 352, which employs the regulator 110 to develop a reference voltage, $V_r$, for use by the flash memory unit 322. The flash memory unit 322 includes a plurality of flash memory chips 326, 328, 330, which act as the resistive load, $R_L$, shown in FIG. 2.

The regulator 110 resides entirely within the controller 352 and is responsive to $V_{dd}$, generating $V_r$ therefrom for use by the flash memory unit 322. In comparing FIGS. 1*a* and 6, it is clear that the system of 350 of FIG. 6 requires less components. That is, the transistor 40, in FIG. 1*a* is eliminated from the system of FIG. 6. This results in less cost for manufacturing a system using the present invention. In addition, with the elimination of such a component, it is easier to electrically design a card, which additionally reduces the costs of manufacturing. Furthermore, as noted earlier, a more dynamic $V_{dd}$ range is tolerated by the system of FIG. 6 while maintaining the reference voltage, $V_r$, supplied to the flash unit 322 substantially constant. This dynamic tolerance further allows a system using the present invention to use batteries, generating $V_{dd}$, for a longer period of time because as batteries are used, with time, the voltage they generate is decreased in level and regulators of the prior art could not tolerate a voltage level lower than generally 4.5V. The present invention, on the other hand, allows use of the batteries even when the voltage they generate falls below 4.5V. This tends to lengthen the lifetime of batteries.

Although the present invention has been particularly shown and described above with reference to a specific embodiment, it is anticipated that alterations and modifications thereof will no doubt become apparent to those skilled in the art. It is therefore intended that the following claims be interpreted as covering all such alterations and modifications as fall within the true spirit and scope of the invention.

What I claim is:

1. A reference voltage generating and regulating circuit comprising:

first circuit means coupled to a system voltage source having a system voltage level, said first circuit means being responsive to a translated voltage control signal having a translated voltage level and operative to generate a reference signal having a reference voltage level; and second circuit means coupled to said system voltage source, said second circuit means being responsive to said reference signal and operative to generate said translated voltage control signal, said translated voltage control signal being adjusted in accordance with voltage variations in said system voltage level, said second circuit including, a reference generator circuit having a reference node for receiving said reference signal and operative to generate a prime reference signal having a prime reference voltage level at a prime reference node, said reference generator circuit having means for maintaining said prime reference signal substantially independent of variations in said reference voltage level and by variations in temperature, a regulator circuit responsive to said prime reference signal and said reference signal and operative to generate a voltage control signal having a control voltage level, a translator circuit coupled to said system voltage source, said translator circuit being responsive to said voltage control signal and operative to generate said translated voltage control signal by translating said control voltage level to said translated voltage level, wherein said first and second circuit means cooperate to divide said system voltage level to that of said reference voltage level while maintaining said reference voltage level substantially unaffected by variations in said system voltage level and by temperature and process variations resulting from manufacturing of said reference voltage generating circuit.

2. A reference voltage generating and regulating circuit as recited in claim 1 wherein said first circuit means comprises:

an output transistor having a gate terminal coupled to receive said translated voltage control signal, a source terminal coupled to said system voltage source, and a drain terminal coupled to an output terminal at which said reference signal is provided.

3. A reference voltage generating and regulating circuit as recited in claim 1 wherein said means for maintaining further includes a first transistor and a resistor means for dividing said reference voltage level of said reference signal to said prime reference voltage level and a second transistor coupled to said first transistor and said resistor means at said prime reference node for maintaining said prime reference voltage level substantially constant despite fluctuations in said reference voltage level and variations in temperature and process, said first transistor having a gate terminal coupled to a ground terminal, a source terminal coupled to receive said reference signal and a drain terminal coupled to said prime reference node, said second transistor having a gate terminal coupled to receive said reference signal, a drain terminal coupled to said prime reference node and a source terminal coupled to said regulator circuit at a first node.

4. A reference voltage generating and regulating circuit as recited in claim 3 wherein said resistor means includes a resistor having a first terminal connected to said reference node and a second terminal coupled to said prime reference node.

5. A reference voltage generating and regulating circuit as recited in claim 4 wherein said second transistor is an NMOS transistor having a size of approximately 40/4 and said first transistor is a PMOS transistor having a size of approximately 27/0.55.

6. A reference voltage generating and regulating circuit as recited in claim 5 further comprising at least one auxiliary trim transistor coupled in parallel to said second transistor and having a gate terminal coupled to receive an auxiliary reference signal for adjusting said prime voltage level.

7. A reference voltage generating and regulating circuit as recited in claim 6 wherein said auxiliary reference signal is programmably generated by an external software-executing source.

8. A reference voltage generating and regulating circuit as recited in claim 1 wherein said reference voltage level changes by no more than approximately 5% when said source voltage level changes from 3.5V to 5.5V.

9. A reference voltage generating and regulating circuit as recited in claim 1 for use with a load circuit coupled to receive said reference signal for drawing current varying between 0 to 60 mA, wherein for such current variations, said reference voltage level varies less than 0.1V.

10. A reference voltage generating and regulating circuit as recited in claim 3 further including a first power conserving transistor having a source terminal connected to said ground terminal and a drain terminal connected to said first node, said first power conserving transistor being controlled by a reset signal for causing said first node to be coupled to said ground terminal during operation of said reference voltage generating circuit when said reset signal is not activated and when said reset signal is activated, for causing said first node to be decoupled from said ground terminal thereby causing said reference voltage generating circuit to go into power conservation mode.

11. A reference voltage generating and regulating circuit as recited in claim 1 where upon temperature variations of 0 to 90 degrees centigrade, said reference voltage level varies no more than 0.1V.

12. A reference voltage generating and regulating circuit as recited in claim 10 wherein said regulator circuit comprises a third transistor having a source terminal coupled to said reference node, a gate terminal coupled to said prime reference node, and a drain terminal coupled to a second node at which said voltage control signal is generated, said regulator circuit further comprising a fourth transistor having a source terminal coupled to said first node, a gate terminal coupled to said reset signal, and a drain terminal coupled to said first node wherein the size of said third transistor is substantially larger than the size of said fourth transistor for causing said control voltage level to increase rapidly toward said reference voltage level.

13. A reference voltage generating circuit as recited in claim 12 wherein said translator circuit comprises:

a fifth transistor having a source terminal coupled to said system voltage source, a gate terminal coupled to said ground terminal, and a drain terminal coupled to a third node;

a sixth transistor having a gate terminal coupled to second node, a drain terminal coupled to said third node, and a source terminal coupled to a fourth node;

an seventh transistor having a source terminal coupled to said system voltage source, a gate terminal coupled to said ground terminal, and a drain terminal coupled to a fifth node; and an eighth transistor having a gate terminal coupled to said third node, a drain terminal coupled to said fifth node, and a source terminal coupled to said fourth node;

wherein said fifth, sixth, seventh and eighth transistors are coupled to cause the voltage level at said fifth node to range from a ground potential level to said source voltage level in response to the change in said control voltage level.

14. A reference voltage generating and regulating circuit as recited in claim 13 wherein said ground terminal is maintained at a potential approximately equal to a ground potential level of 0V.

15. A reference voltage generating and regulating circuit as recited in claim 14 further comprising a second power conserve transistor having a gate terminal coupled to receive said reset signal, a drain terminal coupled to said fourth node, and a source terminal coupled to ground, said second power conserving transistor for causing said fourth node to be coupled to ground when said reset signal is inactive during operation of said circuit and causing said fourth node to be decoupled from ground when said reset signal is active thereby reducing power consumption by said circuit.

16. A reference voltage generating and regulating circuit as recited in claim 15 wherein said translator circuit further includes a low pass filter means for reducing jitter effects on said voltage control signal, said low pass filter means including:

a transistor having a gate terminal connected to said ground terminal, a source terminal connected to said fifth node, and a drain terminal connected to a sixth node at which said translated voltage control signal is provided; and a capacitor having one terminal connected to ground and an opposite terminal connected to said sixth node.

17. A reference voltage generating and regulating circuit as recited in claim 16 wherein said third transistor includes an N-well region coupled to said source voltage source for causing said third transistor to decrease in conductivity and said prime reference voltage level to increase when said source voltage level increases.

18. A reference voltage generating and regulating circuit as recited in claim 17 wherein said third transistor includes an N-well region coupled to said reference voltage source for causing said third transistor to increase in conductivity and said reference voltage level to remain constant when said source voltage level increases.

19. A reference voltage generating circuit as recited in claim 18 further comprising a dampening transistor having a gate terminal coupled to said system voltage source, a drain terminal coupled to said prime reference node, and a source terminal coupled to said second node, said dampening transistor for causing the rate of change of said reference voltage level to drop with respect to the rate of change of said system voltage level.

20. A reference voltage generating circuit as recited in claim 19 wherein said first transistor includes an N-well region coupled to said source voltage for causing the current through said first transistor to further decrease and said reference voltage level to decrease when said source voltage level increases.

21. A reference voltage generating circuit as recited in claim 20 wherein said first transistor includes an N-well region coupled to said reference voltage source for causing the current through said first transistor to further increase and said reference voltage level to increase when said source voltage level increases.

* * * * *